US009784513B2

(12) United States Patent
Zimmer

(10) Patent No.: US 9,784,513 B2
(45) Date of Patent: Oct. 10, 2017

(54) MAGAZINE FLOOR PLATE WITH A STATUS INDICATOR

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 15/398,934

(22) Filed: Jan. 5, 2017

(65) Prior Publication Data

US 2017/0191771 A1 Jul. 6, 2017

Related U.S. Application Data

(60) Provisional application No. 62/275,011, filed on Jan. 5, 2016.

(51) Int. Cl.
*F41A 9/62* (2006.01)
*F41A 9/70* (2006.01)

(52) U.S. Cl.
CPC . *F41A 9/70* (2013.01); *F41A 9/62* (2013.01)

(58) Field of Classification Search
CPC ..... F41A 9/53; F41A 9/62
USPC ..... 42/1.01, 1.02, 1.05
See application file for complete search history.

(56) References Cited

U.S. PATENT DOCUMENTS 387,531 A * 8/1888 Miller ..... F41A 9/72 42/1.02
784,786 A 3/1905 Gottardi
790,634 A * 5/1905 Hirsh ..... F41A 9/28 42/1.01
1,112,055 A * 9/1914 D'Amore ..... F41A 9/18 42/1.02
1,202,768 A * 10/1916 Arnold ..... F41A 9/62 124/52
1,252,094 A * 1/1918 De Lempdes ..... F41A 9/62 235/91 R
1,992,934 A * 3/1935 Bamberger ..... F41A 9/53 42/1.05
4,831,761 A 5/1989 Julakow
(Continued)

FOREIGN PATENT DOCUMENTS

GB 2498393 * 7/2013 ..... F41A 9/62

OTHER PUBLICATIONS

CAA, MAG17—AR Magazine [online], [retrieved on Jan. 5, 2016], Retrieved from the internet <URL: https://usa.caagearup.com/mag17-ar-magazine>.

*Primary Examiner* — Bret Hayes
(74) *Attorney, Agent, or Firm* — Asgaard Patent Services, LLC; F. Wayne Thompson, Jr.

(57) ABSTRACT

Implementations of a magazine floor plate with a status indicator are provided. In some implementations, the magazine floor plate with a status indicator may be used by replacing the floor plate of a magazine for a firearm. In some implementations, the magazine floor plate may be configured to provide a visual and/or tactile indicator that relates to the quantity of ammunition contained within the magazine. In some implementations, the magazine floor plate may comprise a base pad and an internal floor plate having a mechanical indicator device thereon. In some implementations, a portion of the mechanical indicator device extends from the base pad of the magazine floor plate when the magazine is loaded to its minimum indication capacity. In this way, the user is provided with a visual and/or tactile indicator that relates to the quantity of ammunition contained with the magazine.

17 Claims, 8 Drawing Sheets

(56) References Cited

U.S. PATENT DOCUMENTS

| | | | | |
|---|---|---|---|---|
| 5,291,679 | A | 3/1994 | Wollack | |
| 7,536,816 | B2 | 5/2009 | Weinberger | |
| 2010/0251590 | A1* | 10/2010 | Fitzpatrick | F41A 9/65<br>42/50 |
| 2015/0075052 | A1 | 3/2015 | Boyarkin | |
| 2015/0267981 | A1* | 9/2015 | Faughn | F41A 9/62<br>42/1.02 |

* cited by examiner

MAGAZINE FLOOR PLATE WITH A STATUS INDICATOR

CROSS REFERENCE TO RELATED APPLICATION

This application claims the benefit of U.S. patent application Ser. No. 62/275,011, which was filed on Jan. 5, 2016, and is incorporated herein by reference in its entirety.

TECHNICAL FIELD

This disclosure relates to implementations of a magazine floor plate with a status indicator.

BACKGROUND

Modern firearms (e.g., pistols and rifles) often rely on a magazine to contain ammunition and feed the ammunition into the chamber of the barrel. Knowing the quantity of ammunition currently loaded within a magazine is important to military, police, and civilian firearm users as it can affect their decision to use, retain, and/or discard a particular magazine. Depending on the quantity of ammunition loaded into a particular magazine the shooter may decide to take no action as it concerns the magazine, reload the firearm with a different magazine, or select a different magazine from their magazine carrier prior to loading it into the firearm.

Many magazines are constructed of opaque materials. As such, when a magazine is attached to a firearm or positioned within a magazine carrier, the user is unable to see if the magazine is loaded with ammunition without first removing it. Even then, the user is often unable to determine the exact number of rounds contained within the loaded magazine.

Some magazines incorporate transparent or translucent windows allowing the user to see if a magazine is loaded with ammunition. These designs may be of little or no use when the shooter is operating in a low light and/or no light environment.

Accordingly, it can be seen that needs exist for a magazine floor plate with a status indicator. It is to the provision of a magazine floor plate that is configured to provide a visual and/or tactile indicator that relates to the quantity of ammunition contained within a magazine equipped with the magazine floor plate that the present invention is primary directed.

SUMMARY OF THE INVENTION

Implementations of a magazine floor plate with a status indicator are provided. In some implementations, the magazine floor plate with a status indicator may be used by replacing the floor plate of a magazine for a firearm. In some implementations, the magazine floor plate may be configured to provide a visual and/or tactile indicator that relates to the quantity of ammunition contained within the magazine.

In some implementations, the magazine floor plate with a status indicator may comprise a base pad and an internal floor plate having a mechanical indicator device thereon. In some implementations, the mechanical indicator device may comprise an indicator member movable between at least a first position and a second position, a coil spring, and a roll pin. In some implementations, a portion of the indicator member may extend from the base pad of the magazine floor plate when the magazine is loaded to a minimum indication capacity. In this way, the user is provided with a visual and/or tactile indicator that relates to the quantity of ammunition contained with the magazine.

In some implementations, the indicator member of the magazine floor plate may be configured to move between a retracted position and an extended position.

In some implementations, the indicator member stays retracted within the magazine floor plate when the magazine is unloaded and/or contains less than its full capacity of ammunition. In the retracted position, the indicator member is no longer readily visible.

In some implementations, the follower of the magazine causes the indicator member to extend from the base pad when the magazine is fully loaded with ammunition. In the extended position, the indicator member protrudes from the base pad of the magazine floor plate. In this way, the user is provided with a visual and/or tactile indicator that relates to the quantity of ammunition contained within the magazine.

In some implementations, the magazine floor plate could be configured so that the indicator member is moved to the extended position when the detachable magazine is only partially loaded with ammunition (e.g., when a 30 rd magazines is loaded with 28 or more rounds of ammunition).

In some implementations, the indicator member or at least a portion of the indicator member may be distinctly colored. In this way, when the indicator member is in an extended position the user may be provided with a visual indicator that relates to the quantity of ammunition contained within the magazine.

DETAILED DESCRIPTION

FIGS. 1-3, 4A-4B, 5A-5B, 6, and 7A-7B illustrate an example magazine floor plate with a status indicator 100 according to the principles of the present disclosure. In some implementations, the magazine floor plate with a status indicator 100 may be used by replacing the floor plate of a detachable box magazine 160 (see, e.g., FIG. 6). In some implementations, the magazine floor plate 100 may be configured to provide a visual and/or tactile indicator that relates to the quantity of ammunition contained within the magazine 160.

A detachable box magazine is a device that is widely used to feed ammunition into a firearm (e.g., a rifle and/or a pistol). An example detachable box magazine 160 (e.g., a MAGPUL® PMAG®) used with the AR15/M16 family of firearms is depicted in FIGS. 6 and 7A-7B.

Figure 6:
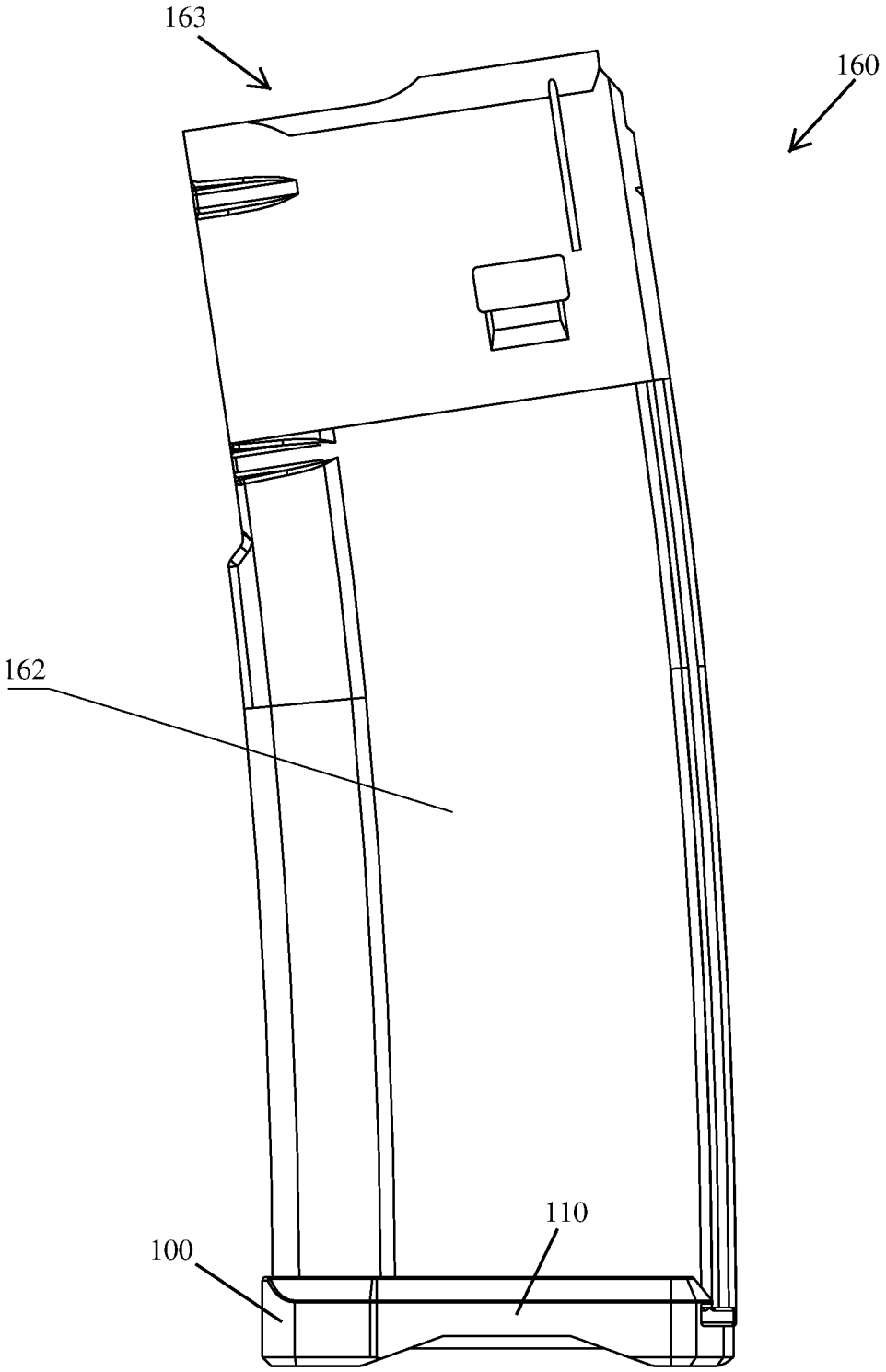
FIG. 6 illustrates a side view of a magazine with a magazine floor plate 100 constructed according to the present invention installed thereon, wherein the indicator member is in the first position of operation.
Figure 7A:
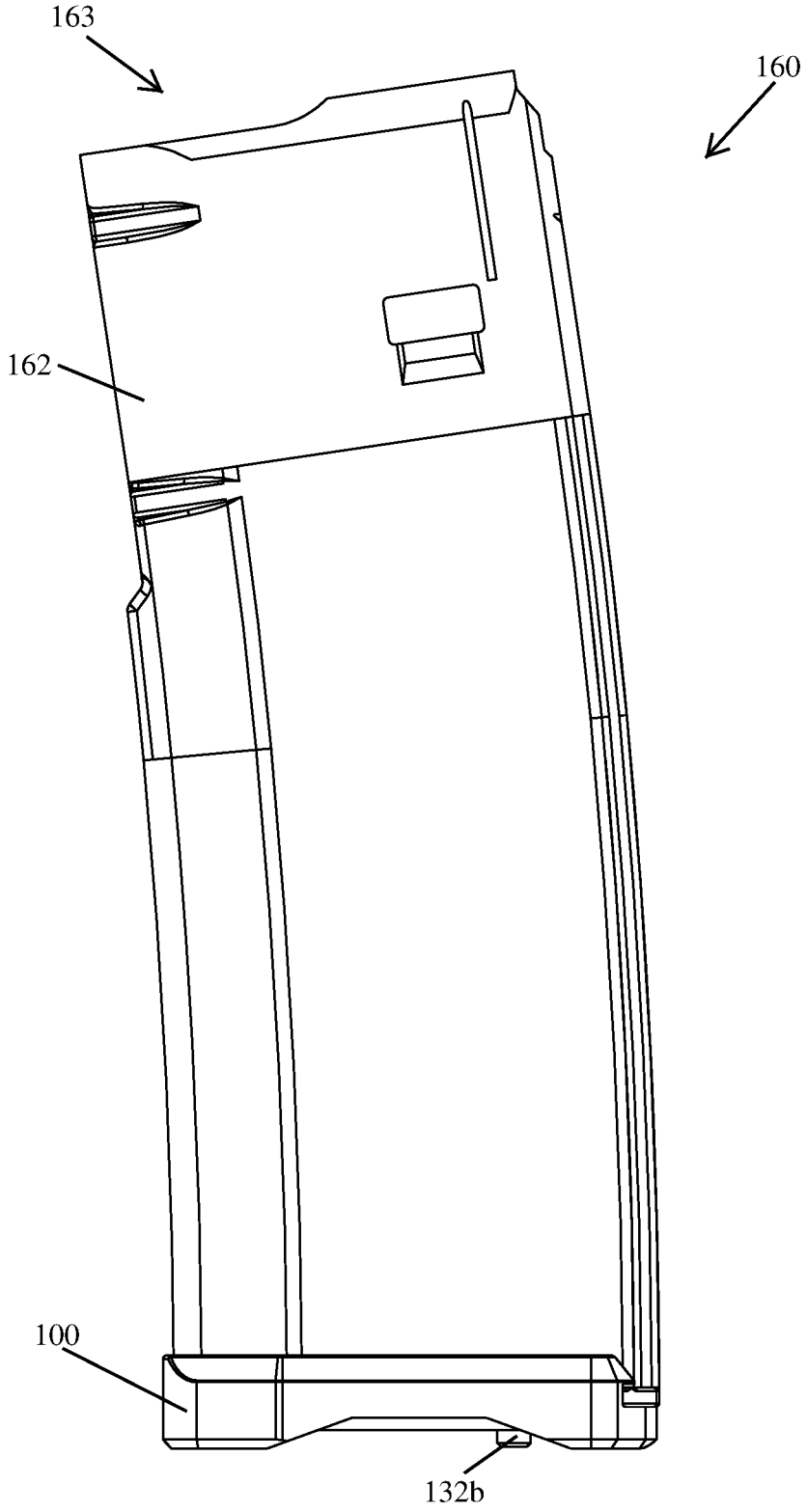
FIG. 7A illustrates a side view of a magazine with a magazine floor plate 100 constructed according to the present invention installed thereon, wherein the indicator member is in the second position of operation.
Figure 7B:
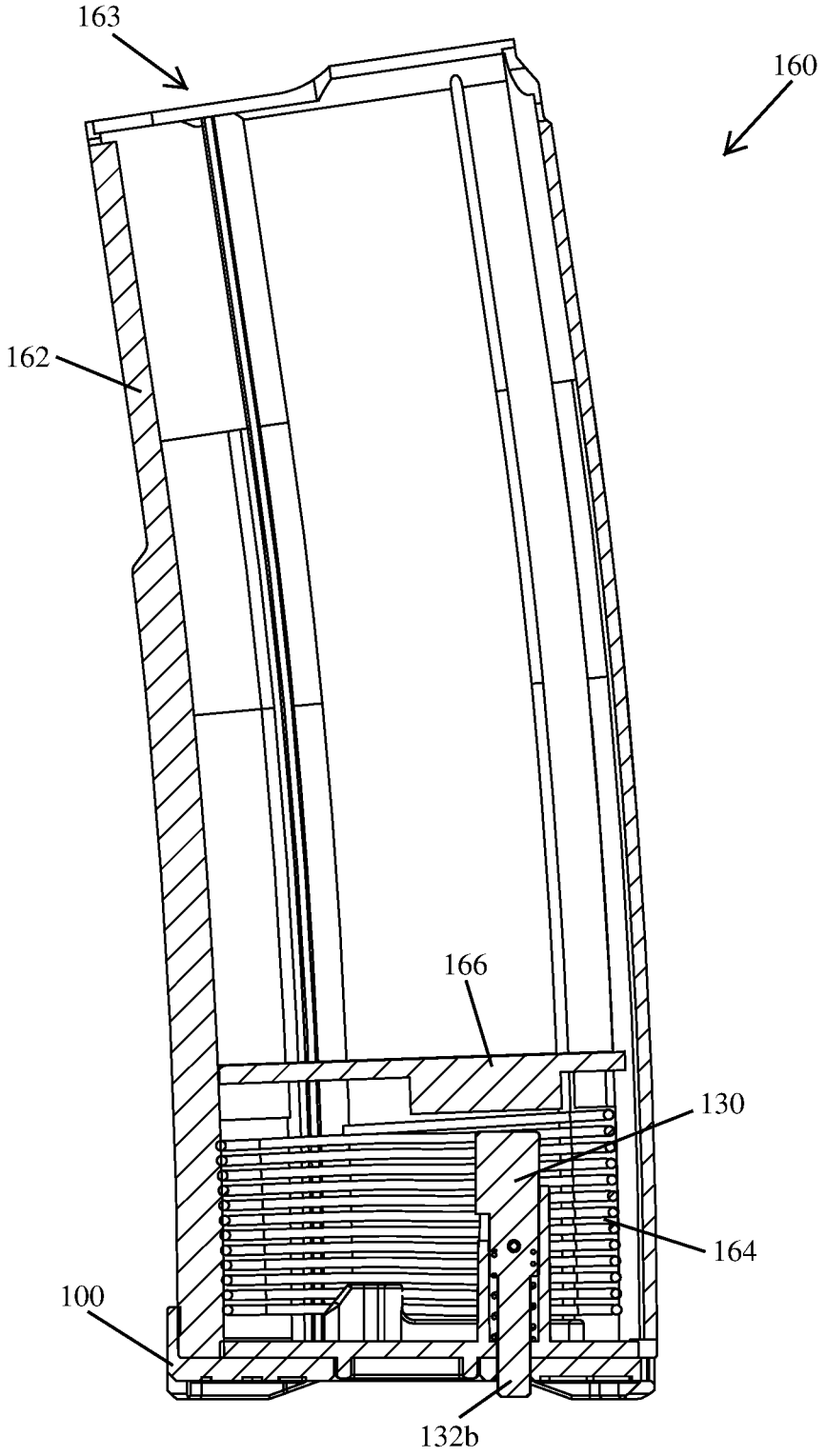
FIG. 7B illustrates a cross-sectional view of the magazine shown in FIG. 7A.

As shown in FIGS. 6 and 7A-7B, in some implementations, the magazine 160 may include an opening 163 through which ammunition is loaded into and unloaded from the magazine body 162, a follower 166 for supporting ammunition loaded into the magazine 160, a spring 164 for resiliently pressing the follower 166 and ammunition resting thereon towards the opening 163 of the magazine 160, and a magazine floor plate 100 constructed according to the present disclosure. The body 162 of the magazine 160 is shaped to hold ammunition in a vertically stacked arrangement. One of ordinary skill in the art will appreciate that the magazine floor plate with a status indicator 100 may be configured to attach to the bottom portion of any box magazine currently known or developed in the future that uses a removable floor plate.

Figure 2:
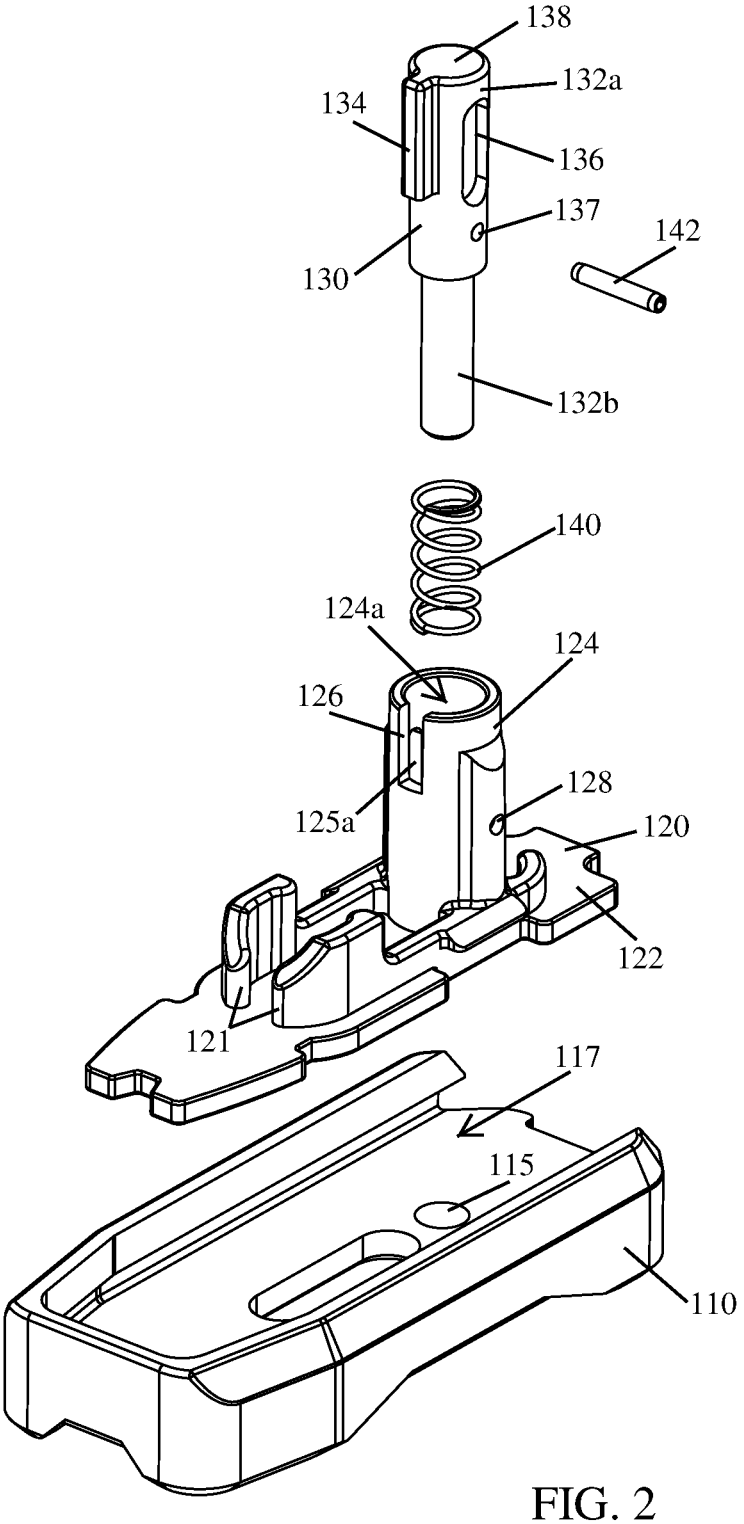
FIG. 2 illustrates an exploded view of the magazine floor plate with a status indicator shown in FIG. 1.

As shown in FIG. 2, in some implementations, the magazine floor plate with a status indicator 100 may comprise a base pad 110 and an internal floor plate 120 having a mechanical indicator device thereon. In some implementation, the mechanical indicator device may comprise an indicator member 130 movable between at least a first position and a second position, a coil spring 140, and a roll pin 142. In some implementations, a portion of the indicator member 130 may protrude from the base pad 110 of the magazine floor plate 100 when the magazine 160 is loaded with ammunition to a minimum indication capacity, discussed in greater detail below (see, e.g., FIGS. 7A and 7B). In this way, the user is provided with a visual and/or tactile indicator that relates to the quantity of ammunition contained within the magazine 160.

Figure 3:
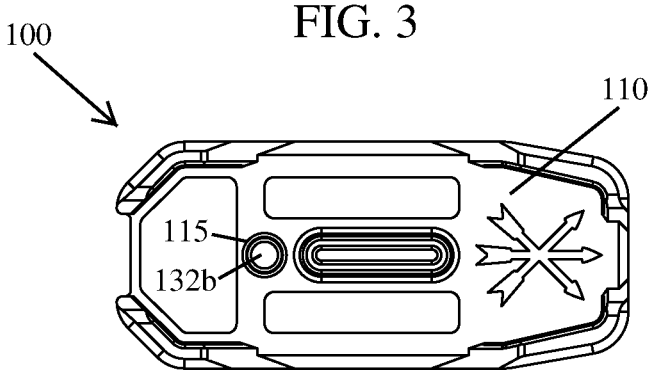
FIG. 3 illustrates a bottom side view of the magazine floor plate with a status indicator shown in FIG. 1.

As shown in FIGS. 2 and 3, in some implementations, the base pad 110 may have an aperture 115 extending therethrough. In this way, at least a portion of the indicator member 130 may extend therethrough during use (see, e.g., FIG. 5B). In some implementations, the aperture 115 may be a circular opening extending through the base pad 110 (see, e.g., FIGS. 2 and 3). In some implementations, the aperture 115 may be any shape suitable for allowing at least a portion of the indicator member 130 to pass therethrough. In some implementations, the base pad 110 may be configured to be secured to the bottom side of a magazine 160 (see, e.g., FIG. 6).

Figure 1:
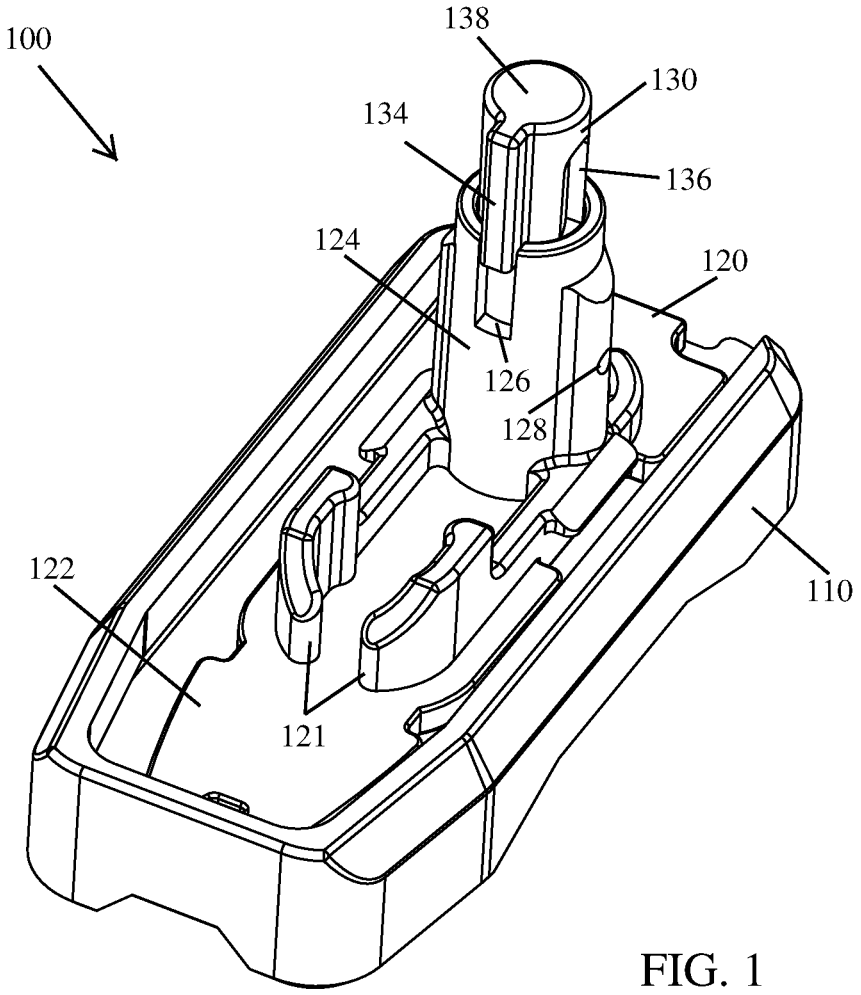
FIG. 1 illustrates an isometric view of a magazine floor plate with a status indicator according to the principles of the present disclosure.

As shown in FIGS. 1 and 2, in some implementations, the internal floor plate 120 may comprise a base member 122 and a guide shaft 124. In some implementations, the internal floor plate 120 may also provide a magazine spring guide 121 thereon. In this way, the magazine spring 164 may be properly positioned within the body 162 of a magazine 160 having a magazine floor plate 100 installed thereon.

As shown in FIG. 2, in some implementations, the guide shaft 124 extends from the base member 122 of the internal floor plate 120 at an angle perpendicular thereto. In some implementations, the guide shaft 124 includes a first opening 124*a* that extends therethrough. In some implementations, the first opening 124*a* through the guide shaft 124 may be any shape suitable for receiving therein at least a portion of the indicator member 130 and the coil spring 140 (see, e.g., FIGS. 2 and 4B). In some implementations, the first opening 124*a* through the guide shaft 124 may be in alignment with the aperture 115 of the base pad 110 when the internal floor plate 120 is seated therein (see, e.g., FIGS. 1 and 5B). In this way, at least a portion (e.g., element 132*b*) of the indicator member 130 may extend therethrough under certain conditions (see, e.g., FIG. 5B).

As shown in FIG. 2, in some implementations, the guide shaft 124 may include a second opening 128 that extends through the exterior thereof. In some implementations, the second opening 128 may be perpendicular to the first opening 124*a*. In some implementations, the second opening 128 may be configured for the roll pin 142 to pass therethrough.

As shown in FIG. 2, in some implementations, the interior of the guide shaft 124 may include a first guide groove 125*a* and a second guide groove (not shown). In some implementation, the guide grooves 125 may be positioned on opposite sides of the first opening 124*a* within the guide shaft 124. In some implementations, the second opening 128 extends through the exterior of the guide shaft 124 and into the second guide groove (see, e.g., FIGS. 2 and 4A). In some implementations, the guide grooves 125 may be configured to limit the up and/or down movement of the roll pin 142 installed on the indicator member 130 (discussed in greater detail below). In this way, the guide grooves 125 may be used to limit the up and/or down movement of the indicator member 130.

As shown in FIG. 2, in some implementations, the indicator member 130 may comprise a first end 132*a* and a second end 132*b*. In some implementations, the first end 132*a* is larger in diameter than the second end 132*b* of the indicator member 130. In some implementations, the first end 132*a* of the indicator member 130 may comprise a tongue 134 extending from a side thereof, a cutout 136 on each side thereof, and a bore 137 extending therethrough.

In some implementations, the tongue 134 on the first end 132 of the indicator member 130 may be configured to be received within a groove 126 in the guide shaft 124 of the internal floor plate 120 (see, e.g., FIG. 1). In this way, the groove 126 of the guide shaft 124 in conjunction with the tongue 134 of the indicator member 130 may prevent the indicator member 130 from rotating within the guide shaft 124. In some implementations, the guide shaft 124 in conjunction with the tongue 134 may be used to limit the downward movement of the indicator member 130. In some implementations, the tongue 134 of the indicator member 130 may be a rectangular shaped protrusion (see, e.g., FIG. 2). In some implementations, the tongue 134 of the indicator member 130 may be any shape suitable for being received within the groove 126 of the guide shaft 124.

Figure 4A:
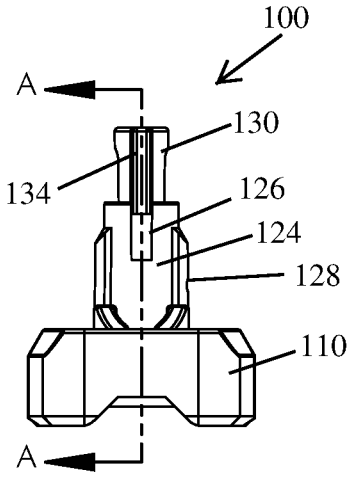
FIG. 4A illustrates a front side view of the magazine floor plate with a status indicator shown in FIG. 1, wherein the indicator member is in the first position of operation.
Figure 4B:
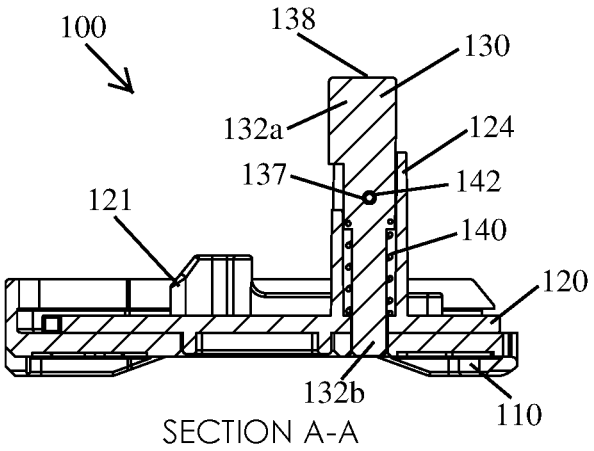
FIG. 4B illustrates a cross-sectional view taken along line A-A of FIG. 4A.

As shown in FIG. 4B, in some implementations, each cutout 136 in the first end of the indicator member 130 may not extend therethrough.

As shown in FIGS. 2 and 4B, in some implementations, the bore 137 is configured to hold a roll pin 142 therein. In some implementations, the length of the bore 137 is less than the length of the roll pin 142 used. In this way, the roll pin 142 may be positioned therein to extend from each end of the bore 137. In some implementations, a solid pin may be used in lieu of a roll pin 142.

Figure 5A:
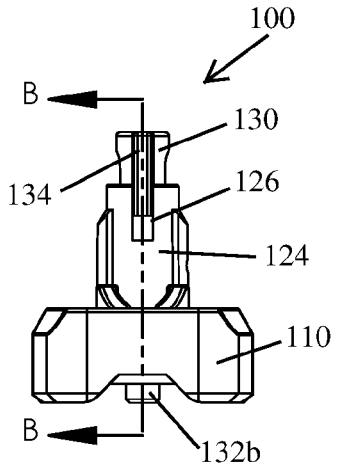
FIG. 5A illustrates a front side view of the magazine floor plate with a status indicator shown in FIG. 4A, wherein the indicator member is in the second position of operation.
Figure 5B:
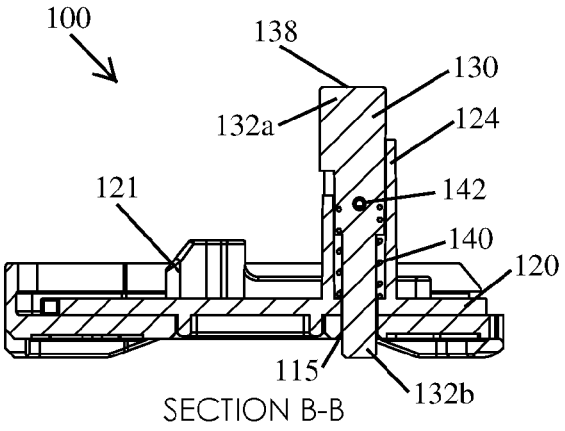
FIG. 5B illustrates a cross-sectional view taken along line B-B of FIG. 5A.

As shown in FIGS. 4B and 5B, in some implementations, the guide grooves 125 within the guide shaft 124 in conjunction with the roll pin 142 secured within the bore 137 limit the up and/or down movement of the indicator member 130 within the guide shaft 124.

As shown in FIG. 5B, in some implementations, the second end 132*b* of the indicator member 130 may be configured to slidably move within the first opening 124*a* of the guide shaft 124 and extend through the aperture 115 of the base pad 110 during use. In some implementations, the coil spring 140 fits about the second end 132*b* of the indicator member 130 when it is positioned within the guide shaft 124 (see, e.g., FIG. 4B). In this way, the coil spring 140 presses against the first end 132*a* of the indicator member 130 when the magazine floor plate 100 is assembled.

To assemble the magazine floor plate with a status indicator 100, in some implementations, the coil spring 140 may be initially inserted into the first opening 124*a* of the guide shaft 124. Then, the second end 132*b* of the indicator member 130 is inserted into the coil spring 140 within the first opening 124*a* of the guide shaft 124 while the first end 132*a* is positioned so that the tongue 134 thereon is received within the groove 126 of the guide shaft 124 (see, e.g., FIGS. 4A and 4B). Next, the indicator member 140 is depressed so that the bore 137 therethrough is aligned with the second opening 128 in the guide shaft 124 of the internal floor plate 120. Then, the roll pin 142 is inserted through the second opening 128 of the guide shaft 124 and into the bore 137 of the indicator member 130 (see, e.g., FIG. 4B). Next, the internal floor plate 120 with the mechanical indicator device installed thereon is seated into the cutout 117 in the base pad 110 (see, e.g., FIGS. 1 and 2). Then, in some implementations, the magazine floor plate with a status indicator 100 may be secured to the bottom of a detachable box magazine 160 (see, e.g., FIG. 6).

In some implementations, the indicator member 130 of the magazine floor plate 100 may be configured to move between a retracted position (or first position) and an extended position (or second position). In some implementations, when the magazine is unloaded and/or contains less than its full capacity of ammunition, the indicator member 130 stays retracted within the base pad 110 (see, e.g., FIGS. 4A and 4B). In some implementations, when the magazine 160 is fully loaded with ammunition the follower 166 moves the indicator member 140 to its second position causing it to extend from the base pad 110 (see, e.g., FIGS. 5A, 5B, and 7B).

In some implementations, when the detachable box magazine 160 is empty, or only partially loaded with ammunition, the follower 166 does not make contact with the top side 138 of the indicator member 130. Without the follower 166 of the magazine 160 depressing the indicator member 130, the coil spring 140 presses against the first end 132*a* of the indicator member 130 thereby causing the second end 132*b* to retract into the base pad 110 (see, e.g., FIGS. 4A and 4B). In this way, the indicator member 130 is no longer readily visible.

In some implementations, when the detachable box magazine 160 is fully loaded with ammunition (e.g., 30 rounds of ammunition) the follower 166 displaces the indicator member 130 by making contact with the top side 138 thereof and compressing the coil spring 140. While the indicator member 130 is depressed by the follower 166 of the magazine, a portion of the second end 132*b* of the indicator member 130 extends through the aperture 115 in the base pad 110 (see, e.g., FIGS. 5A and 5B). In this way, the indicator member 130 is made visible. Further, it may be possible to feel the protruding portion (e.g., element 132*b*) of the indicator member 130 by passing a finger or a portion of the hand over the bottom of the floor plate 100 and thereby determine whether the magazine is fully loaded or not.

In some implementations, the magazine floor plate 100 could be configured so that the indicator member 130 is moved to the extended position when the detachable magazine 160 is only partially loaded with ammunition (e.g., when a 30 round magazine is loaded with 28 and/or 29 rounds of ammunition).

As used herein, the phrase "minimum indication capacity" refers to the minimum quantity of ammunition that a magazine 160 be loaded with in order for the follower 166 to bias the indicator member 130 of a magazine floor plate 100 to an extended position.

In some implementations, the indicator member 130 or at least the second end 132*b* of the indicator member 130 may be a different color than the body of the detachable box magazine 160. In this way, when the indicator member 130 is in an extended position the user may be provided with a visual indicator that relates to the quantity of ammunition contained within the magazine 160.

In some implementations, the indicator member 130 or at least the second end 132*b* of the indicator member 130 may be the same color as the body of the detachable box magazine 160.

While the example detachable box magazine 160 shown is for use with the AR15/M16 family of firearms, it is to be understood that the magazine floor plate with a status indicator 100 invention may be configured for use with other detachable box magazines used to feed ammunition into rifles and/or pistols.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown, or in sequential order, or that all illustrated operations be performed, to achieve desirable results.

The invention claimed is:

1. A magazine floor plate with a status indicator comprising:

a base pad configured to be secured to a magazine for a firearm, the base pad includes an aperture that extends therethrough;

an internal floor plate, the internal floor plate comprises a base member configured to be seated into a cutout of the base pad and a guide shaft, the guide shaft extends from the base member and includes a first opening that extends therethrough, the first opening aligns with the aperture of the base pad when the magazine floor plate is assembled; and a mechanical indicator device comprising an indicator member and a coil spring, the indicator member is movable between a retracted position in which the indicator member does not protrude from the aperture of the base pad and an extended position in which at least a portion of the indicator member extends from the aperture of the base pad, the coil spring is configured to fit about a portion of the indicator member;

wherein the first opening of the guide shaft is configured to receive therein at least a portion of the indicator member and the coil spring.

2. The magazine floor plate of claim 1, wherein the internal floor plate further comprises a magazine spring guide configured to position a magazine spring within a body of a magazine having a magazine floor plate installed thereon.

3. The magazine floor plate of claim 1, wherein the guide shaft extends from the base member of the internal floor plate at an angle perpendicular thereto thereby placing the first opening therethrough into alignment with the aperture of the base pad.

4. The magazine floor plate of claim 1, wherein the indicator member comprises a first end and a second end, the first end includes a bore extending therethrough and a roll pin that extends through the bore, the bore is configured to hold the roll pin; the interior of the guide shaft includes a first guide groove and a second guide groove positioned on opposite sides of the first opening; the guide grooves in conjunction with the roll pin are configured to limit the up and down movement of the indicator member.

5. The magazine floor plate of claim 4, wherein the first end of the indicator member may further comprise a tongue that extends from a side thereof, the tongue is configured to be received within a groove in the guide shaft of the internal floor plate thereby preventing the indicator member from rotating within the guide shaft.

6. The magazine floor plate of claim 5, wherein the tongue on the first end of the indicator member is a rectangular shaped protrusion and the groove in the guide shaft is configured to receive the tongue.

7. The magazine floor plate of claim 4, wherein the first end of the indicator member is larger in diameter than the second end; wherein the coil spring is configured to fit about the second end of the indicator member; wherein the coil spring presses against the underside of the first end of the indicator member when the magazine floor plate is assembled.

8. The magazine floor plate of claim 1, wherein the indicator member is configured to move into the extended position by a magazine follower pressing against a top side thereof and compressing the coil spring.

9. A magazine for a firearm comprising:

a magazine body, the magazine body has an opening into which ammunition is loaded into, and unloaded from, the magazine body;

a follower configured to support ammunition loaded into the magazine body;

a spring for resiliently pressing the follower towards the opening of the magazine body; and a magazine floor plate comprising:

a base pad configured to be secured to the magazine body, the base pad includes an aperture that extends therethrough;

an internal floor plate, the internal floor plate comprises a base member configured to be seated into a cutout of the base pad and a guide shaft, the guide shaft extends from the base member and includes a first opening that extends therethrough, the first opening aligns with the aperture of the base pad when the magazine floor plate is assembled; and a mechanical indicator device comprising an indicator member and a coil spring, the indicator member is movable between a retracted position in which the indicator member does not protrude from the aperture of the base pad and an extended position in which at least a portion of the indicator member extends from the aperture of the base pad, the coil spring is configured to fit about a portion of the indicator member;

wherein the first opening of the guide shaft is configured to receive therein at least a portion of the indicator member and the coil spring.

10. The magazine of claim 9, wherein the internal floor plate further comprises a magazine spring guide configured to position the spring within the magazine body when the magazine is assembled.

11. The magazine of claim 9, wherein the guide shaft extends from the base member of the internal floor plate at an angle perpendicular thereto thereby placing the first opening therethrough into alignment with the aperture of the base pad.

12. The magazine of claim 9, wherein the indicator member comprises a first end and a second end, the first end includes a bore extending therethrough and a roll pin that extends through the bore, the bore is configured to hold the roll pin; the interior of the guide shaft includes a first guide groove and a second guide groove positioned on opposite sides of the first opening; the guide grooves in conjunction with the roll pin are configured to limit the up and down movement of the indicator member.

13. The magazine of claim 12, wherein the first end of the indicator member may further comprise a tongue that extends from a side thereof, the tongue is configured to be received within a groove in the guide shaft of the internal floor plate thereby preventing the indicator member from rotating within the guide shaft.

14. The magazine of claim 13, wherein the tongue on the first end of the indicator member is a rectangular shaped protrusion and the groove in the guide shaft is configured to receive the tongue.

15. The magazine of claim 12, wherein the first end of the indicator member is larger in diameter than the second end; wherein the coil spring is configured to fit about the second end of the indicator member; wherein the coil spring presses against the underside of the first end of the indicator member when the magazine floor plate is assembled.

16. The magazine of claim 9, wherein the indicator member is configured to move into the extended position when the follower presses against a top side thereof and thereby compresses the coil spring.

17. The magazine of claim 9, wherein at least a portion of the indicator member is a different color than the magazine body.

* * * * *